US006530794B2

(12) United States Patent
Littlewood

(10) Patent No.: US 6,530,794 B2
(45) Date of Patent: Mar. 11, 2003

(54) COUPLER

(76) Inventor: Thomas David Shon Littlewood, Overton Lodge, Dyce, Aberdeen, AB21 0EQ (GB)

( * ) Notice: Subject to any disclaimer, the term of this patent is extended or adjusted under 35 U.S.C. 154(b) by 0 days.

(21) Appl. No.: 09/780,180

(22) Filed: Feb. 9, 2001

(65) Prior Publication Data

US 2001/0036774 A1 Nov. 1, 2001

(30) Foreign Application Priority Data

Feb. 10, 2000 (GB) ..... 0002919

(51) Int. Cl.[7] ..... H01R 13/15
(52) U.S. Cl. ..... 439/265
(58) Field of Search ..... 439/259, 197, 439/252, 261, 263, 71, 75, 74, 264, 268, 912, 265

(56) References Cited

U.S. PATENT DOCUMENTS 4,336,646 A 6/1982 Feldman
4,352,533 A * 10/1982 Murase et al. ..... 439/259
4,904,200 A 2/1990 Williams
4,919,627 A 4/1990 Cable
5,295,848 A 3/1994 Mohn
5,718,602 A * 2/1998 Savoca ..... 439/477
6,079,998 A * 6/2000 Kamath ..... 439/259

FOREIGN PATENT DOCUMENTS

GB 1577850 10/1980
GB 2268641 * 12/1994 ..... 439/259

* cited by examiner

*Primary Examiner*—Neil Abrams
*Assistant Examiner*—J. F. Duverne
(74) *Attorney, Agent, or Firm*—The Matthews Firm

(57) ABSTRACT

An apparatus to connect two portions of at least one cable together comprising a male member, a female member and an actuation means. The actuation means is adapted to radially displace the first or second portions of the cables to engage each other. The actuation means typically comprises a tapered rod, and the male member is normally inserted into the female member and the rod is moved along its central axis so that engaging portions abutting against the rod move radially outwards causing the attached cable portions to move radially outward. Secondary portions of the cables are typically positioned around the female member and form a connection with the cables pushed radially outwards.

28 Claims, 6 Drawing Sheets

COUPLER

TITLE OF THE INVENTION

This invention relates to a coupler for joining connections and particularly to a multiway coupler for joining a number of connections, particularly but not exclusively, for use in hostile environments, for example, subsea environments.

BACKGROUND OF THE INVENTION

Umbilicals used underwater typically comprise a number of internal cables, hoses or wires carrying, for example electrical wires, hydraulic lines, pneumatic lines, fibre optic cables or other types of wires, lines or cables used for transmitting, for example, power, signals, data, etc. At the point where the umbilical connects to a host facility or structure with corresponding cables, it may be necessary to connect each cable within the umbilical separately. Such connections may be difficult and time consuming to effect.

This problem has been tackled by connecting and locking two parallel plates, each plate comprising mating connector halves mounted on their mating face. However, these plates are difficult to align and connect, and are prone to damage and to dirt ingress. The problems associated with these plates are exacerbated in subsea or other difficult environments.

SUMMARY OF THE INVENTION

According to a first aspect of the present invention there is provided an apparatus to connect first portions of at least two cables to respective second portions of the at least two cables, the apparatus comprising:

a male member coupled to the first portions of the cables;

a female member coupled to the second portions of the cables;

an actuation mechanism;

wherein the actuation mechanism is adapted to displace at least part of at least one of the first and second portions of the cables radially to engage with the other portions of the cables.

Typically, the female member comprises a bore and is adapted to receive the male member in the bore.

Preferably, the first and second portions of the cables each comprise mating faces. Typically, the first and second portions of the cables engage at their respective mating faces.

Preferably, movement of the actuation mechanism results in the radial displacement of the said at least one of the first and second portions of the cables.

Preferably, the female member is adapted to engage at least a portion of the male member and movement of the actuation mechanism in the direction of engagement of the male and female members results in the radial displacement of the said at least one of the first and second portions of the cables.

Preferably, movement of the actuation mechanism results in the radial displacement of the first portion of the cables radially to engage with the second portion of the cables.

Preferably, the first portions of the cables are displaced radially outwards from the male member.

Preferably, the actuation mechanism comprises a tapered member having a tapered surface.

Preferably, the first portions of the cables comprise an engaging member which is adapted to engage the tapered surface of the tapered member.

Preferably, movement of the tapered member to cause a wider portion of the tapered member to engage with each engaging member causes radial displacement of each engaging member and the first portions of the cables coupled thereto.

Preferably, the face of each engaging member engaging the tapered member is a curved face with a smaller radius of curvature than the face of the tapered member which it engages.

Preferably, each engaging member has at least one slot.

Preferably, a guidance mechanism is provided between the male and female members.

Preferably, the guidance mechanism comprises a first substantially hollow cone-shaped member attached to one of the male and female members and a second cone-shaped member attached to the other of the male and female members wherein the first cone-shaped member is adapted to receive the second cone-shaped member.

Preferably, the male member has a protection mechanism to cover the mating faces of the first portions of the cables.

Preferably, the protection mechanism comprises a tubular member and a biasing device.

Preferably, the biasing device deforms on entry of the male member into the female member to uncover the mating faces of the cables and reforms when the male member is withdrawn from the female member to cover the mating faces of the cables with the tubular member.

Preferably, the male member further comprises an end plate member.

Preferably, each first portion of cable further comprises a supporting member.

Preferably, each supporting member extends from the end plate member to an engaging member.

Preferably, a biasing mechanism is provided to resist radial movement of the supporting members.

Preferably, the apparatus further comprises a rotation alignment mechanism to rotationally align the male and female members with respect to each other.

Preferably, the apparatus further comprises an axial alignment mechanism to axially align the male and female members with respect to each other.

According to a second aspect of the present invention there is provided an apparatus to connect a first portion of a cable to a second portion of the cable, the apparatus comprising:

a male member coupled to the first portion of the cable;

a female member coupled to the second portion of the cable;

an actuation mechanism;

wherein the actuation mechanism is adapted to displace at least part one of the first and second portions of the cable radially to engage with the other portion of the cable.

Preferably, the apparatus according to the second aspect of the invention is substantially similar to the apparatus according to the first aspect of the invention.

According to a third aspect of the invention there is provided a method to connect first portions of at least two cables to second portions of at least two cables, the method comprising the steps of:

providing a male member coupled to the first portions of the cables;

providing a female member coupled to the second portions of the cables;

providing an actuation mechanism; and moving the actuation mechanism such that at least a part of the first or second portions of the cables are radially displaced to engage with the other portions of the cables.

According to a fourth aspect of the invention there is provided a method to connect a first portion of a cable to a second portion of a cable, the method comprising the steps of:

providing a male member coupled to the first portion of the cable;

providing a female member coupled to the second portion of the cable;

providing an actuation mechanism; and moving the actuation mechanism so that at least a part of one of the first and second portions of the cable is radially displaced to engage with the other portion of the cable.

According to a fifth aspect of the invention there is provided an apparatus comprising a female receptacle with at least one individual connector halve(s) and a male coupler with at least one individual mating connector halve(s), that connect and lock with the individual connector halve(s) of the female receptacle when the male multiway coupler is inserted into the female multiway receptacle and is actuated, wherein, the connector actuation mechanism, within the male coupler, consists of a tapered mandrel whose axial travel forces the connector halve(s) radially outwards through holes in the body of the male coupler and into connection with the mating connector halve(s) housed within the female receptacle.

According to a sixth aspect of the invention there is provided an apparatus to connect a plurality of first conduits to respective second conduits, the apparatus comprising:

a male member coupled to the first conduits;

a female member coupled to the second conduits;

an actuation mechanism; and a radially movable portion capable of moving at least one of the conduits;

wherein the actuation mechanism is adapted to move the radially movable portion in a radial direction to connect the first and second conduits.

Preferably, the conduits are cables.

BRIEF DESCRIPTION OF THE DRAWINGS

An embodiment of the invention according to the first aspect of the invention will now be described by way of example only with reference to the accompanying drawings in which.

DETAILED DESCRIPTION OF THE INVENTION

Figure 1:
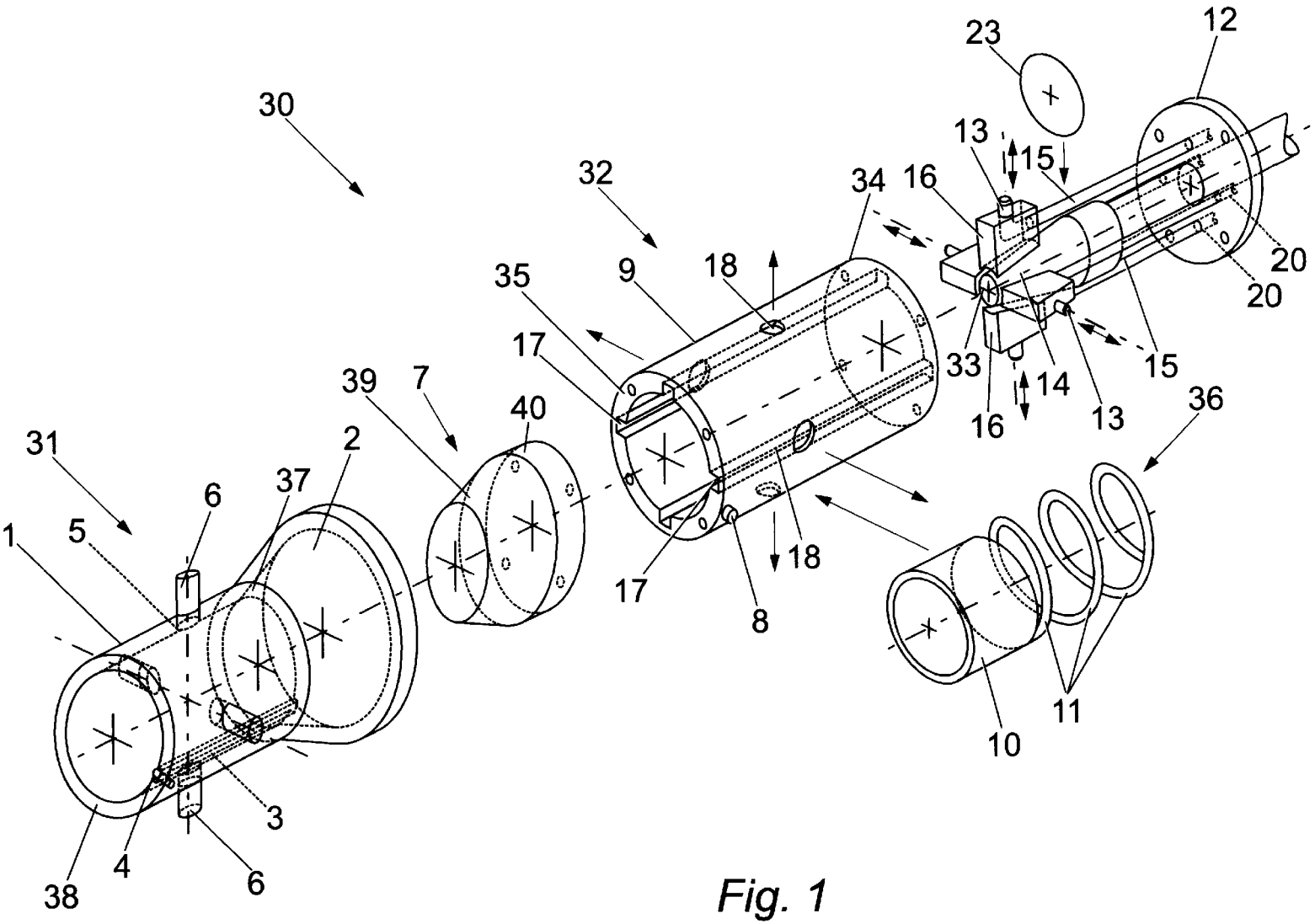
FIG. 1 is an exploded perspective view of the apparatus according to the first aspect of the invention.

Referring to the drawings there is shown a coupler 30 in accordance with the first aspect of the invention, comprising a female member or receptacle 31 and a male member 32.

The male member 32 comprises a casing 9, a sleeve 36, an end plate 12, supporting members 15, a nose cone 7 and a tapered locking rod 14.

Figure 5:
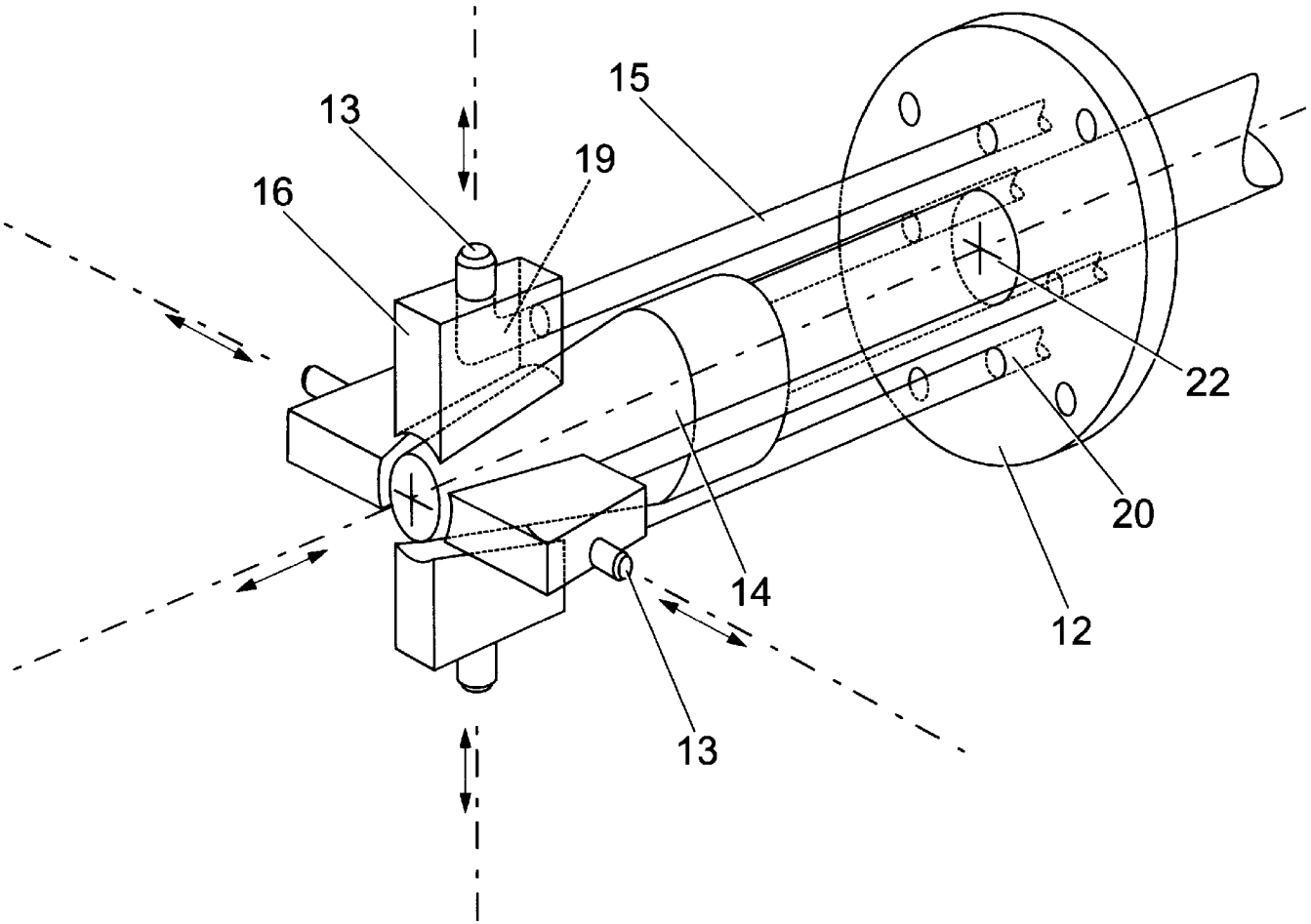
FIG. 5 is a perspective view of part of a male member of the apparatus of FIG. 1.

The supporting members 15 are provided radially around the end plate 12, and extend axially therefrom, and are coupled to blocks 16 which they support. The supporting members 15 are flexible and may be displaced radially. An o-ring 23 is provided around the supporting members 15. After the supporting members 15 have been displaced radially as described below, the o-ring 23 aids their return, and in particular the blocks' 16 return, to their start position as shown in FIG. 1 and FIG. 5.

Individual cables/hoses (not shown) of a host facility/umbilical (not shown) are attached to bulkhead connectors 20 on the rear side of the end plate 12. Each cable (not shown) on the male member 32 extends from bulkhead connectors 20 through the end plate 12, through a supporting member 15, then through the blocks 16 and out through an aperture 18 in the causing 9. A connector half 13 is provided at the end of the cable to engage a complementary connector half 6 on the cable portion of the female member 31.

Figure 6A:
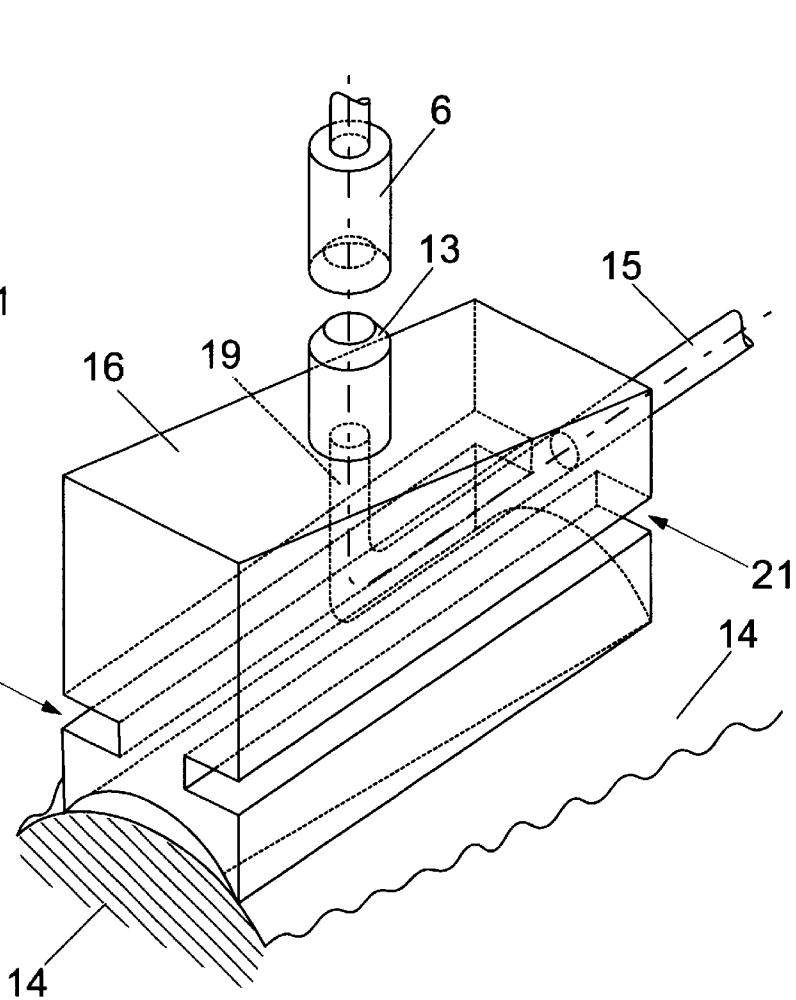
FIG. 6*a* is an enlarged perspective view of a block of the male member of FIG. 5, also showing a portion of cable from the female member.
Figure 6C:
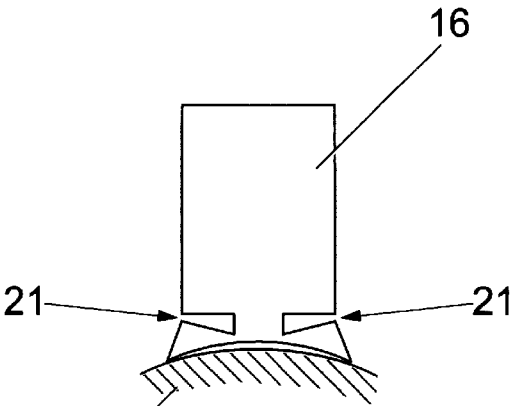
FIG. 6*b* is a side view of the block of FIG. 6*a* (not showing the cables); and, FIG. 6*c* is a side view of the block of FIG. 6*b* in use.
Figure 6B:
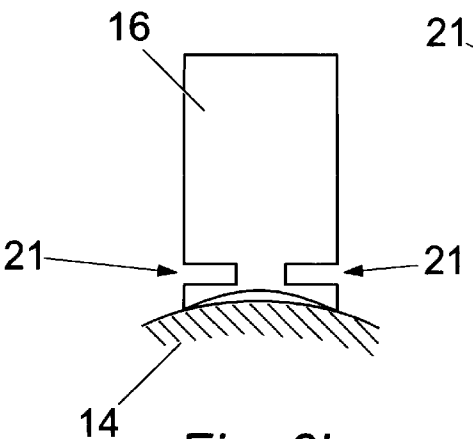

The rod 14 extends co-axially through the centre of the end plate 12. Normally, only the second end 33 of the rod 14 is tapered, wherein the taper runs substantially linearly from a smaller diameter at the outer most portion of the second end 33 to a greater diameter at an inner portion of the second end 33. The male member 32 is arranged such that a radially innermost face of each block 16 rests on the tapered portion of the rod 14. To allow for manufacturing tolerances and to keep the individual connectors 6, 13 firmly held together with a constant holding force, the radially innermost face of each block 16 engaging the tapered portion of the rod is curved with a smaller radius of curvature than the tapered portion of the rod upon which it rests. The blocks 16 have two opposite slots 21, as shown in FIGS. 6*a*–6*c* (but now shown in the other FIGS.), which allow the blocks 16 to resiliently deform.

The blocks 16, supporting members 15, end plate 12 and cables are inserted as a unit into a first end 34 of the casing 9. Each block 16 engages a slot 17 in the casing 9 to rotationally align the blocks 16/supporting members 15 etc with respect to the casing 9. The connector halves 13 of each cable extend through the apertures 18 in the casing 9. An outwardly extending peg 8 is provided on the outer face of the casing 9 opposite to its first end 34 and proximate to its second end 35.

The nose cone 7 comprises a frusto-conical portion 39 and a cylindrical portion 40, wherein the outermost end of the cylindrical portion 40 is attached to the second (opposite) end 35 of the casing 9, and the frusto-conical portion 39 aids location of the male member 32 into the female receptacle 31, as will be described.

The sleeve 36 comprises a solid tubular portion 10 and a tubular spring portion 11. The sleeve 36 is placed around the casing 9 between the peg 8 and the end plate 12 so that the tubular portion 10 covers and protects the connectors 13 provided in the apertures 18 of the casing 9, at least when the male member 32 and female receptacle 31 are not connected.

Figure 2:
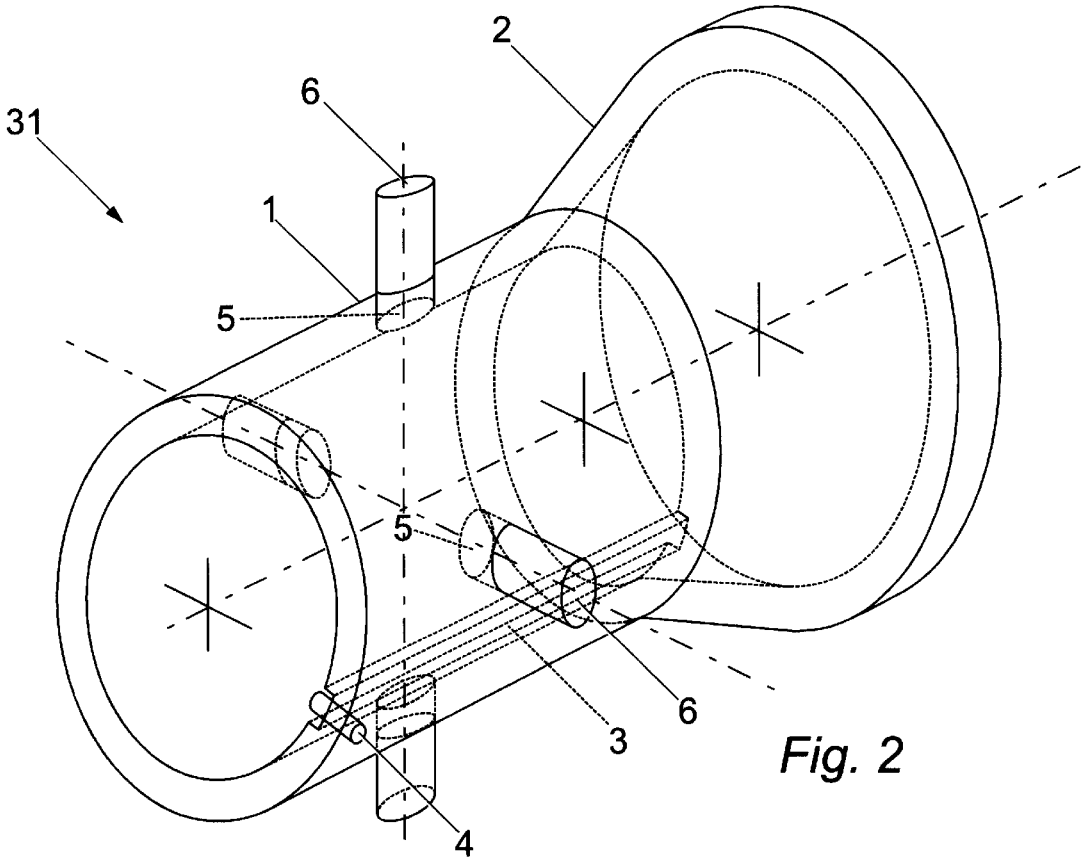
FIG. 2 is a perspective view of a female member of the apparatus of FIG. 1.
Figure 3:
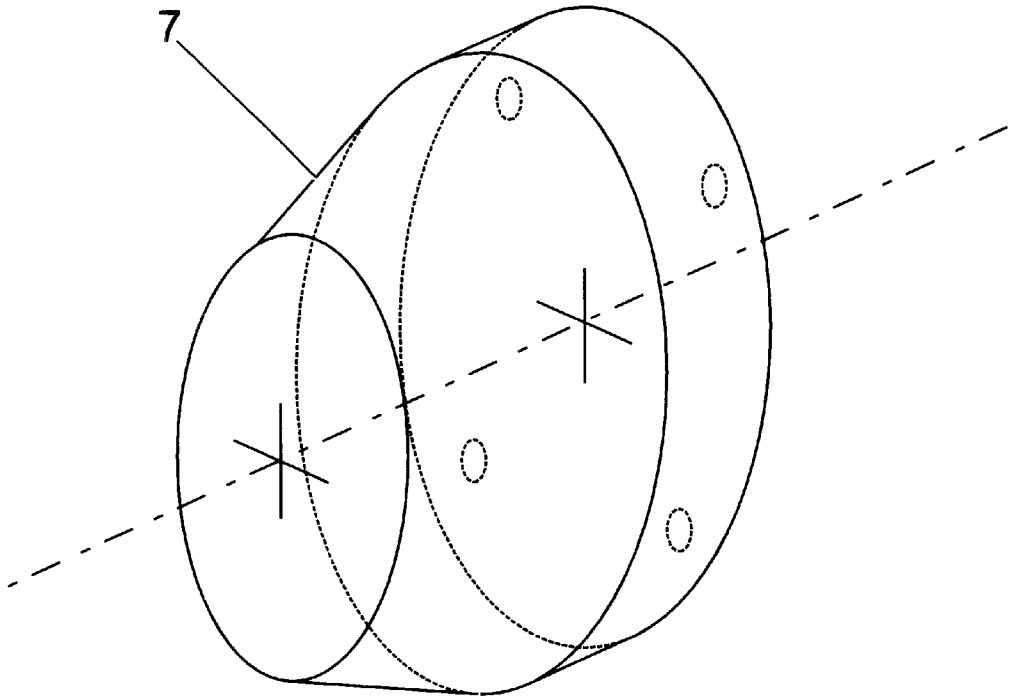
FIG. 3 is a perspective view of a nose cone of the apparatus of FIG. 1.
Figure 4:
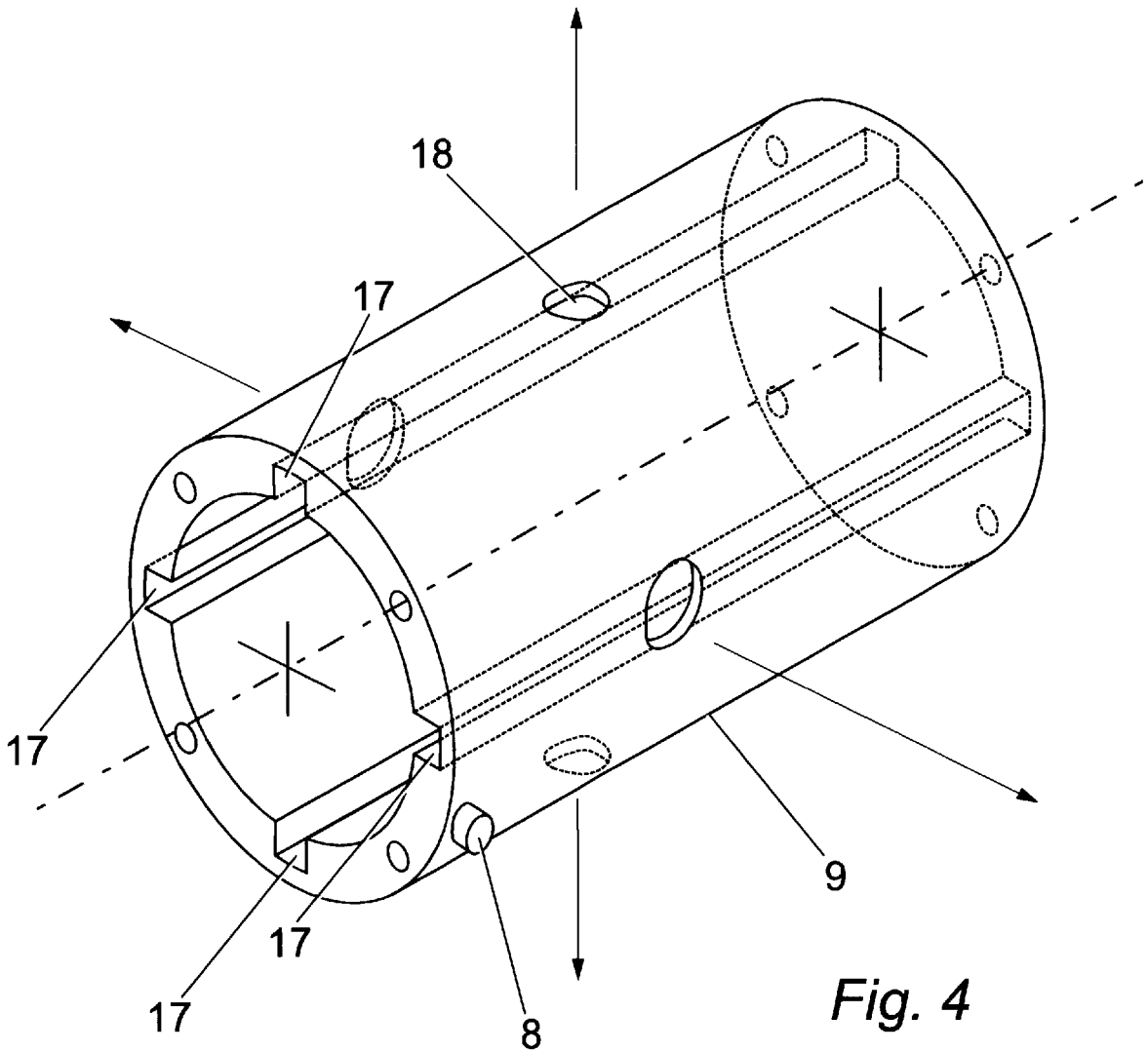
FIG. 4 is a perspective view of a casing of the apparatus of FIG. 1.

The female receptacle 31, shown in greater detail in FIG. 2, comprises a tubular portion 1 and a frusto-conically shaped receptacle 2. Four cable connectors 6 are equi-spaced around the outer face of the tubular portion 1. The individual cables/hoses (not shown) of the host facility/umbilical (not shown) not attached to the bulkhead connectors 20 are attached to the connectors 6. The inner bore of the tube 1 has a diameter large enough to allow entry of the casing 9 but small enough to resist insertion of the sleeve 36. The frusto-conical receptacle 2 is adapted to engage with the nose cone 7 to guide the male member 32 into the inner bore of the female receptacle 31. A slot 3 extends the entire length along the inner face of the tubular portion 1 of the female receptacle 31, and is adapted to engage the peg 8 of the casing 9, as described below.

In use, the male member 32 is inserted into the female receptacle 31. The nose cone 7 guides the male member 32 into the female receptacle 31. The peg 8 on the male member 32 engages with the slot 3 in the female receptacle 31 and so resist rotational movement between the male member 32 and female receptacle 31. The slot 3 in the tubular portion 1 of the female receptacle 31 has an inwardly extending stop peg 4 provided at the opposite end of the tube 1 from the conical member 2.

Therefore, the engagement of the slot 3 and of the peg 8 rotationally aligns the connectors 6 and 13. The sleeve 36, being of wider diameter than the tube 1, abuts the tube's first end 37 and so the insertion of the casing 9 into the tube 1 results in the sleeve 36, and particularly the spring 11, being compressed between the end plate 12 and the first end 37 of the tube 1, insodoing exposing the apertures 18 of the casing 9.

The casing 9 continues into the tube 1 until the peg 8 on the casing 9 abuts against the stop peg 4 in the slot 3 of the tube 1. Continued movement of the casing 9 is thereby resisted.

At this point the connectors 13 in the apertures 18 of the casing 9 are axially and rotationally aligned with the connectors 6 in the apertures 5.

The first end of the rod 14 (the end extending from the rear side of the end plate 12) is gripped by any suitable means such as a hydraulic cylinder or lead screw mechanism (not shown), and the rod 14 is pushed further into the female receptacle 31. As the casing 9 is held by the pegs 4, 8 abutting against each other, the rod 14 now moves independently of the casing 9. The blocks 16 resting on the rod 14 contact a wider (greater diameter) portion of the tapered rod 14 and are pushed radially outwards. The supporting members 15 are also displaced radially outwards against the biasing action of the o-ring 23. The blocks 16 in turn push the connectors 13 further outwardly, through respective apertures 18 in the casing 9, such that the connectors 13 mate with the respective connectors 6 of the female receptacle 31.

The connection between the cables/hoses attached to the connectors 6 and the cables/hoses attached to the connectors 13 is thus formed. The rod 14 may be locked in position by any suitable means (not shown). Internal pressure or other environmental forces which may affect the connection are resisted by the blocks 16 abutting with the tapered rod 14 thereby enhancing the integrity of the connection between the connectors 6 and 13.

To disengage the connection, the procedure is generally reversed, that is, the rod 14 is retracted.

The blocks 16 can then rest on a thinner (smaller diameter) portion of the tapered rod 14, and the o-ring 23 around the supporting members 15 aids this return of the blocks 16. The connection is broken by the connectors 13 retracting back into the casing 9. The male member 32 is then free to be retracted back out of the female receptacle 31. The spring 11 of the sleeve 36 reforms and the connectors 13 in the apertures 18 are once again covered and protected by the tubular portion 10 of the sleeve 36.

The coupler 30 may be used to connect cables conveying any type of signals or power whatsoever including but not limited to pneumatic, electrical, hydraulic or optical signals or power.

It will be understood that although the embodiment described herein relates to a coupler connecting four cables, the scope of the invention is not limited to such a coupler, as any number of cables may be connected with a coupler according to the first, second, third, fourth, fifth or sixth aspects of the present invention with simple modifications being made to the embodiment.

Improvements and modifications may be made without departing from the scope of the invention.

I claim:

1. Apparatus to connect first portions of at least two cables to respective second portions of the at least two cables, the apparatus comprising:

a generally cylindrical male member having a longitudinal central axis, the male member being coupled to the first portion of the cables;

a generally cylindrical female member having a longitudinal central axis, the female member being coupled to the second portions of the cables;

an actuation mechanism comprising a tapered member having a tapered surface, wherein one of the first and second portions of the cables comprise engaging members adapted to engage the tapered surface;

a casing device comprising a plurality of apertures;

wherein movement of the tapered member along the longitudinal central axis of the male member is adapted to displace, through the apertures of the casing device, at least part of at least one of the first and second portions of the cables radially in a direction substantially perpendicular to the longitudinal axis of the male and female members, to engage with the other portions of the cables.

2. Apparatus as claimed in claim 1, wherein the female member is adapted to receive at least a portion of the male member.

3. Apparatus as claimed in claim 1, wherein the first and second portions comprise mating faces and the respective first and second portions of the cables engage at their mating faces.

4. Apparatus as claimed in claim 2, wherein the female member is adapted to engage at least a portion of the male member and movement of the tapered member in the direction of engagement of the male and female members results in the radial displacement of the said at least one of the first and second portions of the cables.

5. Apparatus as claimed in claim 1, wherein movement of the tapered member results in the radial displacement of the first portion of the cables radially to engage with the second portion of the cables.

6. Apparatus as claimed in claim 1, wherein the first portions of the cables are displaced radially outwards from the male member.

7. Apparatus as claimed in claim 1, wherein the first portions of the cables comprise the engaging member which is adapted to engage the tapered surface of the tapered member.

8. Apparatus as claimed in claim 7, wherein movement of the tapered member to cause a wider portion of the tapered member to engage with each engaging member causes radial displacement of each engaging member said the first portions of the cables coupled thereto.

9. Apparatus as claimed in claim 7, wherein the face of each engaging member engaging the tapered member is a curved face with a smaller radius of curvature than the face of the tapered member which it engages.

10. Apparatus as claimed in claim 7, wherein each engaging member has at least one slot.

11. Apparatus as claimed in claim 1, wherein a guidance mechanism is provided between the male and female members.

12. Apparatus as claimed in claim 11, wherein the guidance mechanism comprises a first substantially hollow cone-shaped member attached to one of the male and female member and a second cone-shaped member attached to the other of the male and female members wherein the first cone-shaped member is adapted to receive the second cone-shaped member.

13. Apparatus as claimed in claim 1, wherein the male member has a protection mechanism to cover the mating faces of the first portions of the cables.

14. Apparatus as claimed in claim 13, wherein the protection mechanism comprises a tubular member and a biasing device.

15. Apparatus as claimed in claim 14, wherein the biasing device deforms on entry of the male member into the female member to uncover the mating faces of the cables and reforms when the male member is withdrawn from the female member to cover the mating faces of the cables with tubular member.

16. Apparatus as claimed in claim 1, wherein the male member further comprises an end plate member.

17. Apparatus as claimed in claim 1, wherein each first portion of cable further comprises a supporting member.

18. Apparatus as claimed in claim 17, wherein the male member further comprises an end plate member and each supporting member extends from the end plate member to an engaging member.

19. Apparatus as claimed in claim 17, wherein a biasing mechanism is provided to resist radial movement of the supporting members.

20. Apparatus as claimed in claim 1, further comprising a rotation alignment mechanism to rotationally align the male and female members with respect to each other.

21. Apparatus as claimed in claim 1, further comprising an axial alignment mechanism to axially align the male and female members with respect to each other.

22. Apparatus as claimed in claim 3, wherein the male member comprises the casing device through which the mating faces can protrude.

23. Apparatus to connect a first portion of a cable to a second portion of the cable, the apparatus comprising:

a generally cylindrical male member having a longitudinal central axis, the male member being coupled to the first portion of the cable;

a generally cylindrical female member having a longitudinal central axis, the female member being coupled to the second portion of the cable;

an actuation mechanism comprising a tapered member having a tapered surface, wherein one of the first and second portions of the cable comprises engaging members adapted to engage the tapered surface;

a casing device comprising at least one aperture therein;

wherein movement of the tapered member along the longitudinal central axis of the male member is adapted to displace, through the aperture of the casing device, at least part of one of the first and second portions of the cable radially in a direction substantially perpendicular to the longitudinal axis of the male and female members, to engage with the other portion of the cable.

24. A method to connect first portions of at least two cables to second portions of at least two cables, the method comprising the steps of:

providing a generally cylindrical male member, having a longitudinal central axis, coupled to the first portions of the cables;

providing a generally cylindrical female member, having a longitudinal central axis, coupled to the second portions of the cables;

providing an actuation mechanism comprising a tapered member having a tapered surface, wherein one of the first and second portions of the cables comprise engaging members adapted to engage the tapered surface;

providing a casing device comprising a plurality of apertures; and moving the tapered member along the longitudinal central axis of the male member such that at least a part of the first or second portions of the cables are radially displaced, through the apertures of the casing device, in a direction substantially perpendicular to the longitudinal axis of the male and female members, to engage with the other portions of the cables.

25. A method to connect a first portion of a cable to a second portion of a cable, the method comprising the steps of:

providing a generally cylindrical male member, having a longitudinal central axis, coupled to the first portion of the cable;

providing a generally cylindrical female member, having a longitudinal central axis, coupled to the second portion of the cable;

providing an actuation mechanism comprising a tapered member having a tapered surface, wherein one of the first and second portions of the cable comprises engaging members adapted to engage the tapered surface;

providing a casing device comprising at least one aperture therein; and moving the tapered member along the longitudinal central axis of the male member such that at least a part of one of the first and second portions of the cable is radially displaced, through the aperture of the casing device, in a direction substantially perpendicular to the longitudinal axis of the male and female members, to engage with the other portion of the cable.

26. An apparatus comprising a generally cylindrical female multiway receptacle with at least one individual mating connector halve(s);

and a generally cylindrical male multiway coupler with at least one individual mating connector halve(s) that connect and lock with the individual connector halve(s) of the female receptacle when the male multiway coupler is inserted into the female multiway receptacle and is actuated;

wherein the apparatus further comprises a connector actuation mechanism, provided within the male coupler, wherein the connector actuation mechanism within the male coupler comprises a tapered mandrel whose axial travel forces the mating connector halve(s) of the male multiway coupler radially outwardly through holes provided in a body of the male multiway coupler and into connection with the mating connector halve(s) which are housed within the female multiway receptacle.

27. Apparatus to connect a plurality of first conduits to respective second conduits, the apparatus comprising:

a generally cylindrical male member having a longitudinal central axis, the male member being coupled to the first conduits;

a generally cylindrical female member having a longitudinal central axis, the female member being coupled to the second conduits;

an actuation mechanism comprising a tapered member having a tapered surface, wherein one of the first and second conduits comprise engaging members adapted to engage the tapered surface;

a casing device comprising a plurality of apertures; and a radially movable portion capable of moving at least one of the conduits through the aperture in the casing device;

wherein movement of the tapered member along the longitudinal central axis of the male member is adapted to move the radially movable portion in a radial direction substantially perpendicular to the longitudinal axis of the male and female members to connect the first and second conduits.

28. Apparatus as claimed in claim 21, wherein the conduits are cables.

* * * * *